US012601522B2

(12) United States Patent
Meng et al.

(10) Patent No.: US 12,601,522 B2
(45) Date of Patent: Apr. 14, 2026

(54) DRAIN PAN ADAPTER AND A DRAIN PAN

(71) Applicant: Johnson Controls Tyco IP Holdings LLP, Milwaukee, WI (US)

(72) Inventors: Lingjun Meng, Andover, KS (US); Lanson D. Owen, Maize, KS (US); Lester D. Sherrow, Wichita, KS (US)

(73) Assignee: Johnson Controls Light Commercial IP GmbH, Schaffhausen (CH)

( * ) Notice: Subject to any disclaimer, the term of this patent is extended or adjusted under 35 U.S.C. 154(b) by 229 days.

(21) Appl. No.: 18/447,954

(22) Filed: Aug. 10, 2023

(65) Prior Publication Data

US 2024/0053052 A1 Feb. 15, 2024

Related U.S. Application Data

(60) Provisional application No. 63/397,501, filed on Aug. 12, 2022.

(51) Int. Cl.
*F24F 13/22* (2006.01)

(52) U.S. Cl.
CPC ..... *F24F 13/222* (2013.01)

(58) Field of Classification Search
CPC ..... F24F 13/222
See application file for complete search history.

(56) References Cited

U.S. PATENT DOCUMENTS

2020/0064054 A1* 2/2020 Carlton ..... F28F 17/005
2022/0235980 A1* 7/2022 Mercer ..... F28D 1/0426

* cited by examiner

*Primary Examiner* — Elizabeth J Martin
(74) *Attorney, Agent, or Firm* — Kelly McGlashen

(57) ABSTRACT

A heating, ventilation, and air conditioning (HVAC) system may include a heat exchanger to condition an air flow, and conditioning the air flow may generate condensate. The HVAC system may also include a drain pan that collects the condensate and a drain pan adapter coupled between the drain pan and the heat exchanger. The drain pan adapter may include a coil receiver for engaging a portion of the heat exchanger and a retaining arm that reduces an amount of the air flow over the portion of the heat exchanger.

19 Claims, 9 Drawing Sheets

DRAIN PAN ADAPTER AND A DRAIN PAN

CROSS-REFERENCE TO RELATED APPLICATIONS

This application claims priority to and the benefit of U.S. Provisional Application No. 63/397,501, entitled "A DRAIN PAN ADAPTER AND A DRAIN PAN," filed Aug. 12, 2022, which is hereby incorporated by reference in its entirety for all purposes.

BACKGROUND

The present disclosure relates generally to heating, ventilation, and/or conditioning (HVAC) systems for a building.

Environmental control systems are utilized in residential, commercial, and industrial environments to control environmental properties, such as temperature and humidity, for occupants of the respective environments. The environmental control system may control the environmental properties through control of an air flow delivered to the environment. In some cases, environmental control systems include a vapor compression system, which includes heat exchangers, such as a condenser and an evaporator, that transfer thermal energy between the vapor compression system and the environment. Fans or blowers may direct a flow of supply air across a heat exchange area of the evaporator, and refrigerant circulating through the evaporator may absorb thermal energy from the supply air. Accordingly, the evaporator may discharge conditioned air, which is subsequently directed toward a cooling load, such as an interior of a building. In some instances, the evaporator may condense moisture suspended within the supply air, and condensate may form on an exterior surface of the evaporator. The condensate is generally directed to a drain pan that collects the condensate generated by the evaporator. However, in some scenarios, the air flow passing across the evaporator may displace condensate accumulated thereon and/or dripping therefrom such that the condensate lands in an undesirable or less desirable location (e.g., beyond the drain pan).

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to a heating, ventilation, and air conditioning (HVAC) system that may include a heat exchanger to condition an air flow. Conditioning the air flow may generate condensate. The HVAC system may also include a drain pan that collects the condensate and a drain pan adapter coupled between the drain pan and the heat exchanger. The drain pan adapter may include a coil receiver for engaging a portion of the heat exchanger and a retaining arm that reduces an amount of the air flow over the portion of the heat exchanger.

The present disclosure also relates to a drain pan adapter that includes a coil receiver that engages a portion of a heat exchanger and a retaining arm disposed on a first side of the coil receiver and has one or more openings. Additionally, the drain pan adapter may include a base extending from the coil receiver and through the one or more openings to direct condensate away from the portion of the heat exchanger and through the opening(s).

The present disclosure further relates to a heating, ventilation, and air conditioning (HVAC) unit having an evaporator that conditions an air flow, generating condensate. The HVAC unit may also include a drain pan to collect the condensate and a drain pan adapter coupled between the drain pan and the evaporator. The drain pan adapter may include a coil receiver to engage a portion of the evaporator, a retaining arm having one or more openings, and a base extending from the coil receiver and through the opening(s) to direct the condensate away from the portion of the evaporator and through the opening(s).

BRIEF DESCRIPTION OF THE DRAWINGS

Various aspects of this disclosure may be better understood upon reading the following detailed description and upon reference to the drawings in which.

DETAILED DESCRIPTION

Figure 1:
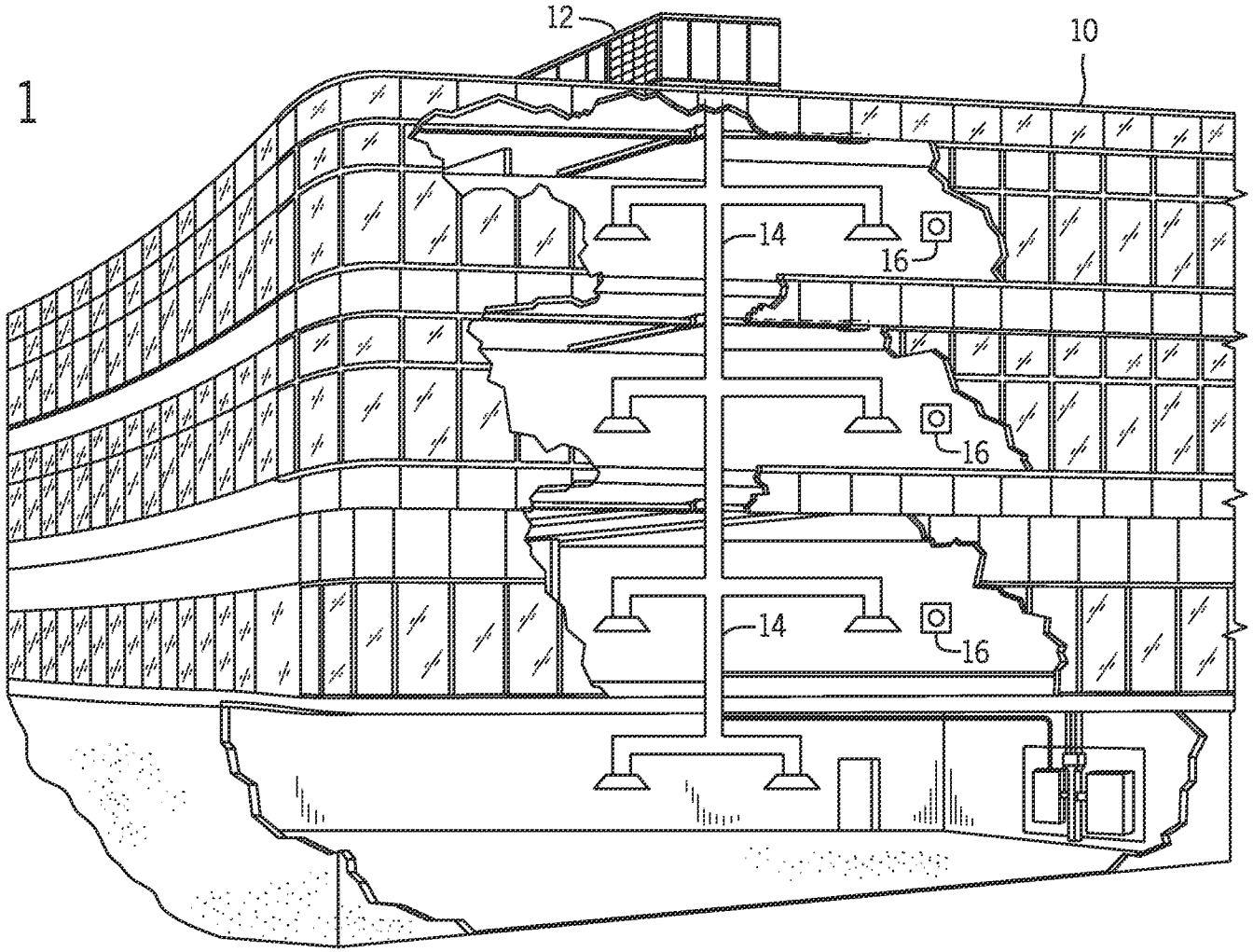
FIG. 1 is a perspective view of an embodiment of a building incorporating a heating, ventilation, and/or air conditioning (HVAC) system in a commercial setting, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, of the given value or even closer. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

In general, a heating, ventilation, and/or air conditioning (HVAC) system may be used to thermally regulate a space within a building, home, or other suitable structure. For example, the HVAC system may include a vapor compression system that transfers thermal energy between a working fluid, such as a refrigerant, and a fluid to be conditioned, such as air. The vapor compression system includes heat exchangers (e.g. a condenser, an evaporator) that are fluidly coupled to one another via one or more conduits to form a refrigerant circuit. A compressor may be used to circulate the refrigerant through the refrigerant circuit and enable the transfer of thermal energy between components of the vapor compression system (e.g., the condenser, the evaporator) and one or more thermal loads (e.g., an environmental air flow, a supply air flow).

Furthermore, one or more heat exchangers of the HVAC system may operate to condition a flow of air that is supplied to a conditioned space, such as the interior of a building. The air to be conditioned may include ambient (e.g., outside) air, return air, a mixture of ambient air and return air, and/or another suitable flow of air. The HVAC system may include one or more fans or blowers that direct a flow of air across a heat exchange area of a heat exchanger to enable conditioning (e.g., heating, cooling, dehumidification) of the air. For example, the refrigerant within an evaporator may absorb thermal energy from the air flow, thereby cooling the air flow before the air flow is discharged toward a conditioned space as a supply air flow.

Cooling of the air flow via the evaporator may cause moisture suspended within the air flow to condense, thereby forming condensate. In certain instances, condensate generated via the evaporator may initially collect on the heat exchange area of the evaporator. Condensate formed and/or accumulated on the evaporator may fall (e.g., via force of gravity or assisted by the air flow) toward a drain pan positioned vertically beneath the evaporator. The drain pan may collect the condensate that falls from the evaporator and direct the condensate toward a drain or other suitable discharge outlet. For example, in some cases an HVAC system or HVAC unit having an evaporator may be arranged to direct an air flow across the evaporator in a generally lateral direction, and a drain pan may be positioned vertically beneath the evaporator. However, in some scenarios, the air flow passing across the evaporator may displace condensate accumulated thereon and/or dripping therefrom such that the displaced condensate (e.g., blow off) lands in an undesirable or less desirable location (e.g., beyond the drain pan).

In some scenarios, the shape, size, orientation, and/or relative location of the evaporator with respect to the drain pan may change the displacement of the condensate and contribute to or reduce blow off. For example, the evaporator of an HVAC unit may be formed such that gravity draws condensate to a lower portion of the evaporator positioned above a drain pain to minimize blow off. However, different evaporators may change the direction of flow and/or interaction of the condensate with the air flow passing over the evaporator such that the condensate is displaced to areas other than the drain pan. For example, in some scenarios, a microchannel evaporator, in a similar implementation as a traditional evaporator (e.g., utilizing a plate-fin heat exchanger), may cause condensate to blow off differently such that the same drain pan and/or configuration may not be as suitable at preventing blow off. As such, in some embodiments, a drain pan adapter may be fitted such that the same drain pan and/or general configuration may be utilized for multiple different types, sizes, and/or shapes of evaporators.

Turning now to the drawings, FIG. 1 illustrates an embodiment of a heating, ventilation, and/or air conditioning (HVAC) system for environmental management that employs one or more HVAC units in accordance with the present disclosure. As used herein, an HVAC system includes any number of components that enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor to detect a climate characteristic or operating parameter, a filter, a control device to regulate operation of an HVAC system component, a component to enable regulation of climate characteristics, or a combination thereof. An "HVAC system" is a system that provides functions such as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12, in accordance with present embodiments. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air-cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment of FIG. 1, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit that operates in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
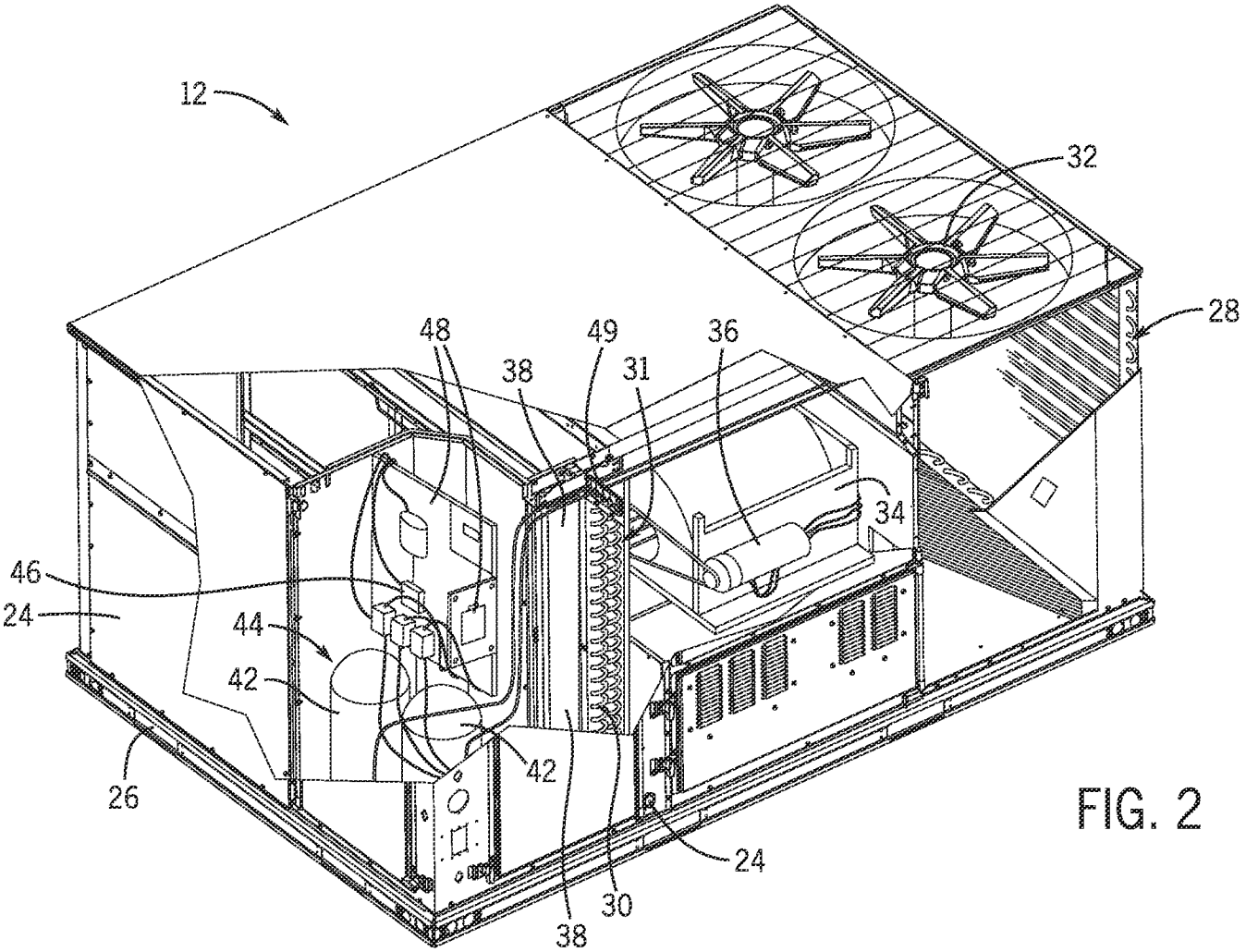
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that is separated from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may control operation of the equipment, provide alarms, and monitor safety switches. Wiring 49 may connect the control board 48 and the terminal block 46 to the equipment of the HVAC unit 12.

Figure 3:
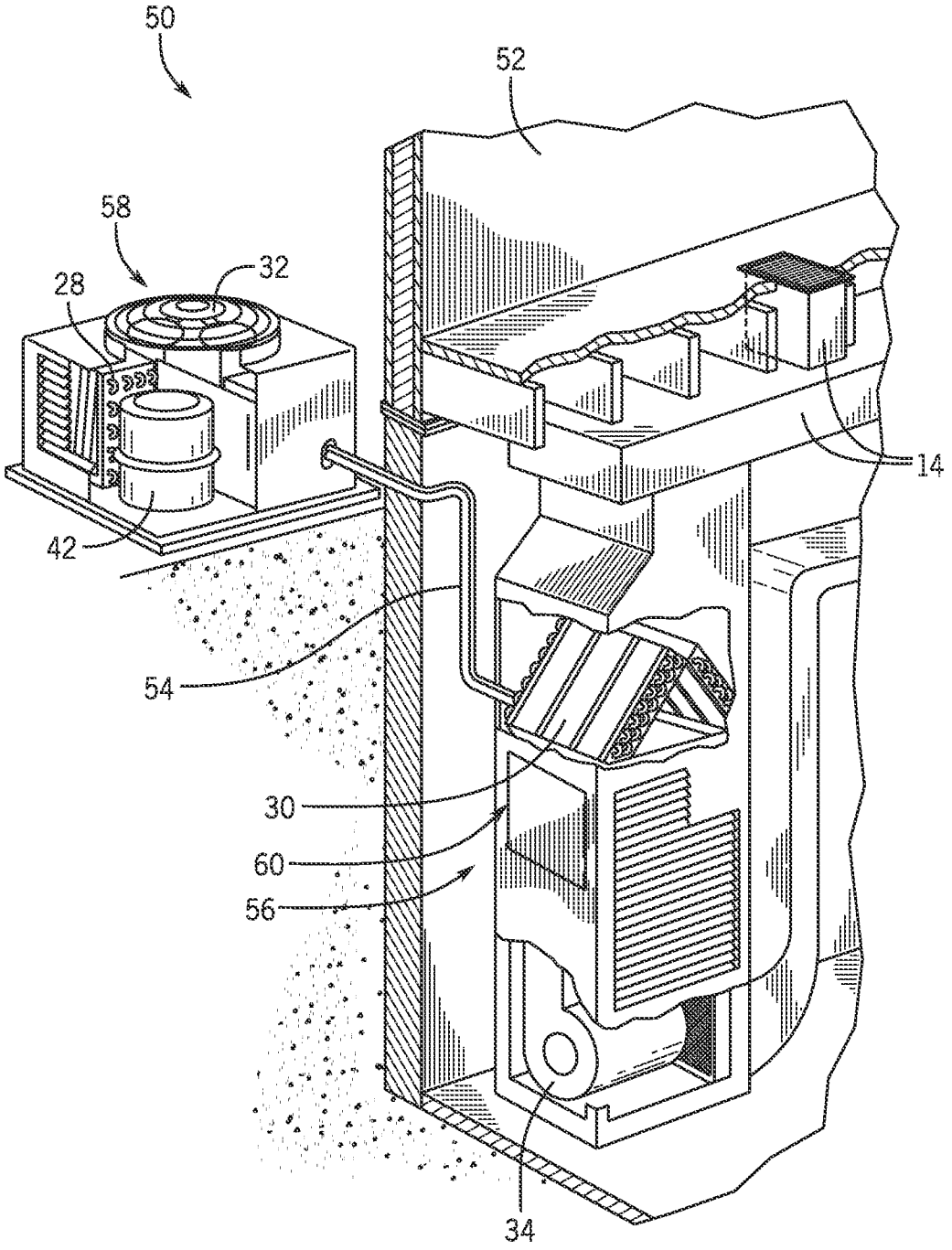
FIG. 3 is a perspective view of an embodiment of a split, residential HVAC system, in accordance with an aspect of the present disclosure.

FIG. 3 illustrates a split HVAC system 50, also in accordance with present techniques. The split HVAC system 50 may provide heated and cooled air to a structure, as well as provide outside air for ventilation and provide improved indoor air quality (IAQ) through devices such as ultraviolet lights and air filters. In the illustrated embodiment, the split HVAC system 50 is a residential heating and cooling system. In general, a residence 52 conditioned by a split HVAC system 50 may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the split HVAC system 50 of FIG. 3 is operating as an air conditioner, a heat exchanger 28 in the outdoor unit 58 serves as a condenser for re-condensing vaporized refrigerant flowing from the indoor unit 56 to the outdoor unit 58 via one of the refrigerant conduits 54. In these applications, a heat exchanger 30 of the indoor unit functions as an evaporator. Specifically, the heat exchanger 30 receives liquid refrigerant, which may be expanded by an expansion device, and evaporates the refrigerant before returning it to the outdoor unit 58.

The outdoor unit 58 draws environmental air through the heat exchanger 28 using a fan 32 and expels the air above the outdoor unit 58. When operating as an air conditioner, the air is heated by the heat exchanger 28 within the outdoor unit 58 and exits the unit at a temperature higher than it entered. The indoor unit 56 includes a blower assembly 34 or fan that directs air through or across the indoor heat exchanger 30, where the air is cooled when the system is operating in air conditioning mode. Thereafter, the air is passed through ductwork 14 that directs the air to the residence 52. The overall system operates to maintain a desired temperature as set by a system controller. When the temperature sensed inside the residence 52 is higher than the set point on the thermostat (e.g., control device 16), or the set point plus a small amount, the split HVAC system 50 may become operative to refrigerate additional air for circulation through the residence 52. When the temperature reaches the set point, or the set point minus a small amount, the split HVAC system 50 may stop the refrigeration cycle temporarily. In some embodiments, the outdoor unit 58 may include a reheat system.

The split HVAC system 50 may also operate as a heat pump. When operating as a heat pump, the roles of heat exchangers 28 and 30 are reversed. That is, the heat exchanger 28 of the outdoor unit 58 will serve as an evaporator to evaporate refrigerant and thereby cool air entering the outdoor unit 58 as the air passes over the outdoor heat exchanger 28. The indoor heat exchanger 30 will receive a stream of air blown over it and will heat the air by condensing the refrigerant.

In some embodiments, the indoor unit 56 may include a furnace system 60. For example, the indoor unit 56 may include the furnace system 60 to supplement or supplant a heat pump mode of the split HVAC system 50. The furnace system 60 may include a burner assembly and heat exchanger, among other components, inside the indoor unit 56. Fuel is provided to the burner assembly of the furnace 60 where it is mixed with air and combusted to form combustion products. The combustion products may pass through tubes or piping in a heat exchanger, separate from heat exchanger 30, such that air directed by the blower assembly 34 passes over the tubes or pipes and extracts heat from the combustion products. The heated air may then be routed from the furnace system 60 to the ductwork 14 for heating the residence 52.

Figure 4:
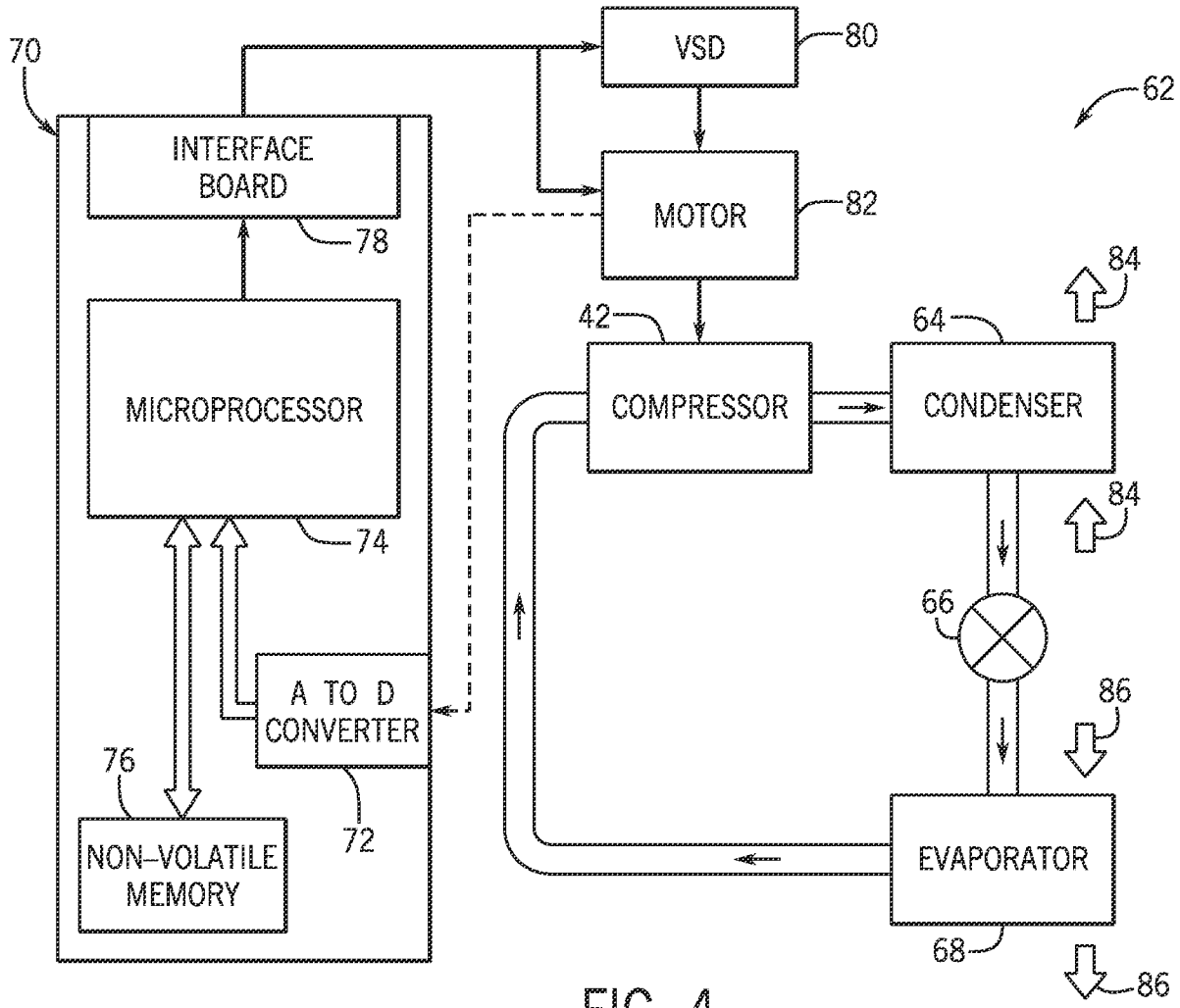
FIG. 4 is a schematic diagram of an embodiment of a vapor compression system used in an HVAC system, in accordance with an aspect of the present disclosure.

FIG. 4 is a schematic view of a vapor compression system 62 that can be used in any of the systems described herein. The vapor compression system 62 may circulate a refrigerant through a circuit motivated by a compressor 42. The circuit may also include a condenser 64 (e.g., heat exchanger 28, 30), an expansion valve(s) or device(s) 66, and an evaporator 68 (e.g., heat exchanger 28, 30). The vapor compression system 62 may further include a control panel 70 that has an analog to digital (A/D) converter 72, a microprocessor 74, a non-volatile memory 76, and/or an interface board 78. The control panel 70 and its components may function to regulate operation of the vapor compression system 62 based on feedback from an operator (e.g., via control device 16), from sensors (e.g., control device 16) of the vapor compression system 62 that detect operating conditions, and so forth.

In some embodiments, the vapor compression system 62 may use a variable speed drive (VSDs) 80 and/or a motor 82 to drive the compressor 42. The VSD 80 receives alternating current (AC) power having a particular fixed line voltage and fixed line frequency from an AC power source, and provides power having a variable voltage and frequency to the motor 82. In other embodiments, the motor 82 may be powered directly from an AC or direct current (DC) power source. The motor 82 may include any type of electric motor that can be powered by a VSD 80 or directly from an AC or DC power source, such as a switched reluctance motor, an induction motor, an electronically commutated permanent magnet motor, or another suitable motor.

The compressor 42 compresses a refrigerant vapor and delivers the vapor to the condenser 64 through a discharge passage. In some embodiments, the compressor 42 may be a centrifugal compressor. The refrigerant vapor delivered by the compressor 42 to the condenser 64 may transfer heat to a fluid passing across the condenser 64, such as ambient or environmental air 84. The refrigerant vapor may condense to a refrigerant liquid in the condenser 64 as a result of thermal heat transfer with the environmental air 84. The liquid refrigerant from the condenser 64 may flow through the expansion device 66 to the evaporator 68.

The liquid refrigerant delivered to the evaporator 68 may absorb heat from another air stream, such as a supply air stream 86 provided to the building 10 or the residence 52. For example, the supply air stream 86 may include ambient or environmental air, return air from a building 10 or residence 52, or a combination of the two. The liquid refrigerant in the evaporator 68 may undergo a phase change from the liquid refrigerant to a refrigerant vapor. In this manner, the evaporator 68 may reduce the temperature of the supply air stream 86 via thermal heat transfer with the refrigerant. Thereafter, the vapor refrigerant exits the evaporator 68 and returns to the compressor 42 by a suction line to complete the cycle.

Figure 5:
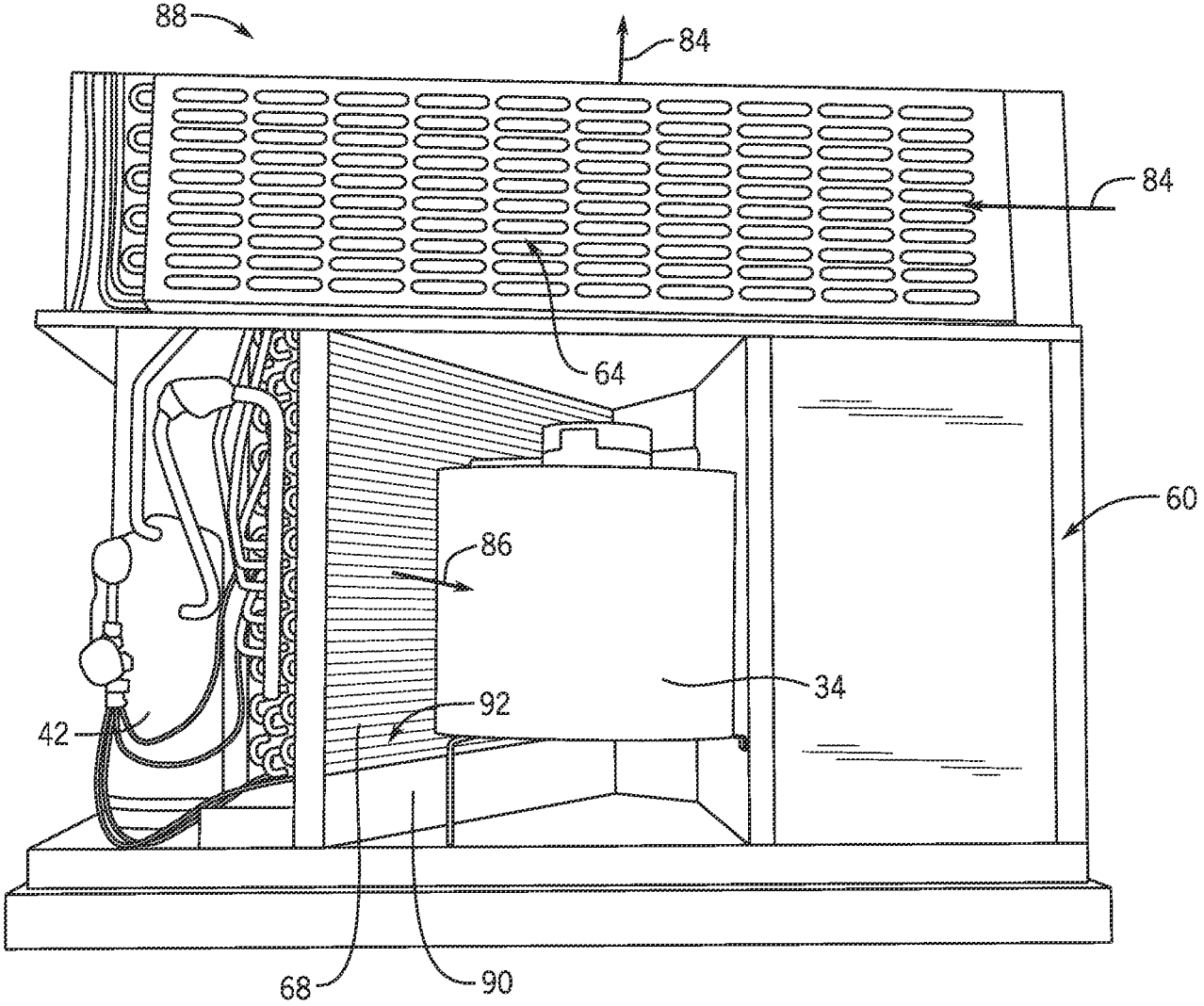
FIG. 5 is a schematic view of a packaged HVAC unit, in accordance with an aspect of the present disclosure.

It should be appreciated that any of the features described herein may be incorporated with the HVAC unit 12, the split HVAC system 50, or other HVAC systems. For example, while the split HVAC system 50 is described above as being utilized for residential structures (e.g., residences 52), in some scenarios, a packaged unit 88 including a condenser 64, evaporator 68, and/or furnace system 60 within the same enclosure (e.g., cabinet 24), as shown in FIG. 5. For example, the supply air stream 86 may be provided to the packaged unit 88 and returned to residence 52 or building 10 via ductwork 14. As should be appreciated, the condenser 64 and evaporator 68 may be considered as heat exchanger 28 and heat exchanger 30, respectively, and the roles of each may be reversed depending on implementation (e.g., operating as an air conditioner or heat pump).

As discussed herein, cooling of an air flow (e.g., supply air stream 86) via the evaporator 68 may cause moisture suspended within the air flow to condense, thereby forming condensate. In certain instances, condensate generated via the evaporator 68 may initially collect on the heat exchange area of the evaporator. Condensate formed and/or accumulated on the evaporator 68 may fall (e.g., via force of gravity or assisted by the air flow) toward a drain pan 90 positioned vertically beneath the evaporator 68. The drain pan 90 may collect the condensate that falls from the evaporator 68 and direct the condensate toward a drain or other suitable discharge outlet. For example, in some cases an HVAC system (e.g., split HVAC system 50) or HVAC unit (e.g., HVAC unit 12 or packaged unit 88) having an evaporator 68 may be arranged to direct an air flow (e.g., supply air stream 86) across the evaporator 68 in a generally lateral direction, and a drain pan 90 may be positioned vertically beneath the evaporator 68. However, in some scenarios, the air flow passing across the evaporator 68 may displace condensate accumulated thereon and/or dripping therefrom such that the displaced condensate (e.g., blow off) lands in an undesirable or less desirable location (e.g., beyond the drain pan). Such blow off may damage components of the HVAC unit 12, 56, 88, an area surrounding the HVAC unit 12, 56, 88, and/or ductwork 14. For example, the condensate may cause rusting of surfaces in or around the HVAC unit 12, 56, 88 or ductwork 14. Furthermore, accumulation of condensate in ductwork 14 and/or portions of the HVAC unit 12, 56, 88 may cause growth of mold or bacteria, which may hamper indoor air quality (IAQ) of the confined space.

In some scenarios, the shape, size, orientation, and/or relative location of the evaporator 68 with respect to the drain pan 90 may change the displacement of the condensate and contribute to or reduce blow off. For example, the evaporator 68 may be formed such that gravity draws condensate to a lower portion 92 of the evaporator 68 positioned above a drain pan 90 to minimize blow off. However, different evaporators 68 may change the direction of flow and/or interaction of the condensate with the air flow passing over the evaporator 68 such that the condensate is displaced to areas other than the drain pan 90. For example, in some scenarios, a microchannel evaporator, in a similar implementation as a traditional evaporator (e.g., utilizing a plate-fin heat exchanger), may cause condensate to blow off differently such that the same drain pan 90 and/or configuration may not be as suitable at preventing blow off. As such, in some embodiments, a drain pan adapter may be fitted such that the same drain pan 90 and/or general configuration may be utilized for multiple different types, sizes, and/or shapes of evaporators 68.

Figure 6:
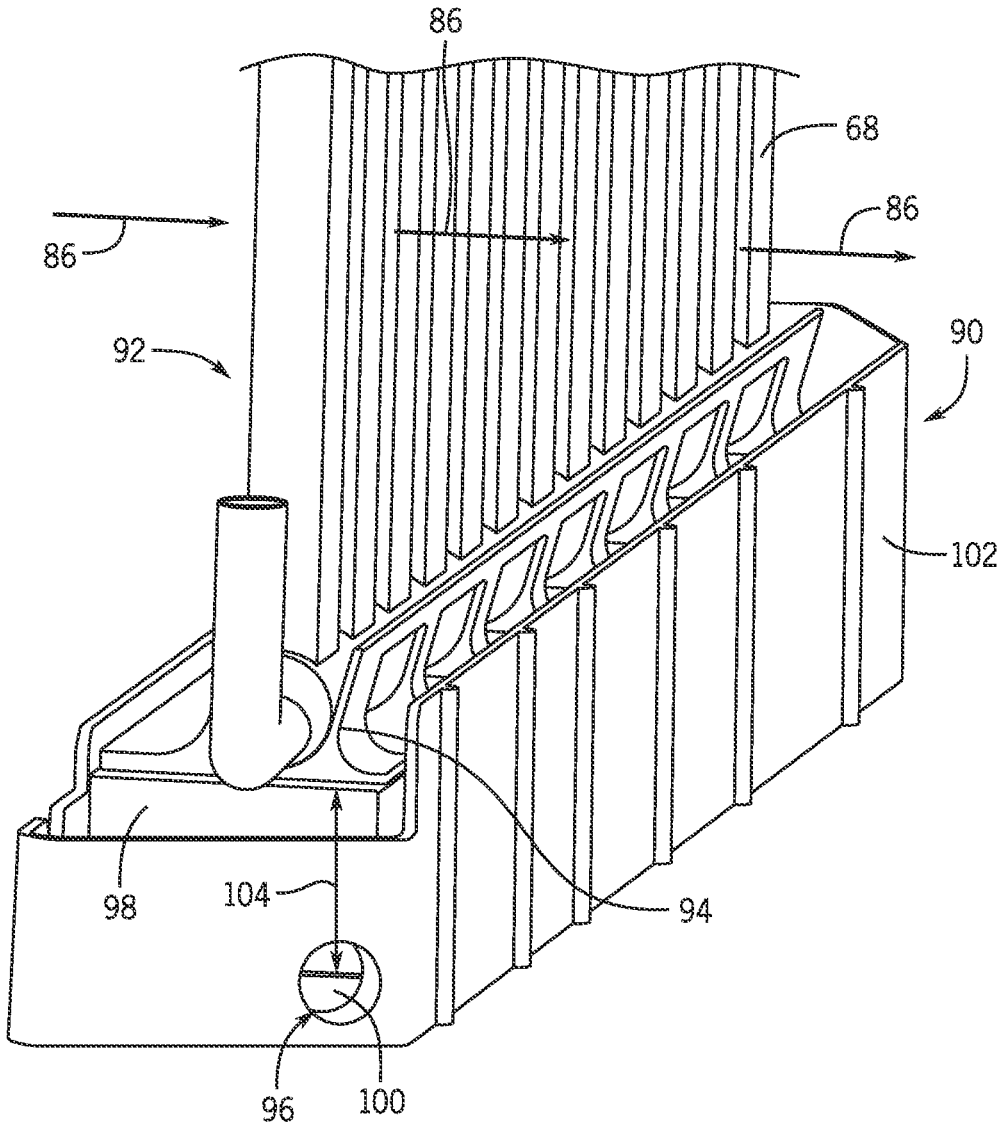
FIG. 6 is a perspective view of a drain pan adapter disposed between a heat exchanger and a drain pan, in accordance with an aspect of the present disclosure.

To help further illustrate, FIG. 6 is an example of a lower portion 92 of an evaporator 68 above a drain pan 90 and engaging with a drain pan adapter 94 to reduce blow off. In some embodiments, the drain pan 90 includes a drain outlet 96 to remove condensate from the drain pan 90. The drain outlet 96 may direct condensate to a desired location and/or connect to piping for removal of the condensate.

As discussed above, in some embodiments, the same drain pan 90 may be utilized with multiple different evaporators 68. However, in some scenarios, the drain pan adapter 94 may provide improved interfacing for the evaporator 68 and drain pan 90 for securing the evaporator 68 in place and/or reducing blow off. For example, in some embodiments, the drain pan adapter 94 may reduce blow off associated with an evaporator 68 with a microchannel heat exchanger, by retaining the lower portion 92 of the evaporator 68 within the footprint of the drain pan 90 and facilitating draining of condensate that may accumulate at the bottom of the evaporator 68. As discussed further below, the drain pan adapter 94 may include features, such as openings, retaining walls, etc. that direct or otherwise provide passages for the condensate to be collected in a drain pan.

In some embodiments, the lower portion 92 of the evaporator 68 may be disposed within the confines of the drain pan 90 or utilize a riser 98 to elevate the evaporator off the base 100 of the drain pan 90. For example, the evaporator 68 may be mounted or disposed on or at the base 100 the drain pan adapter 94 sufficiently below a sidewall 102 of the drain pan 90 such that condensate does not blow out from within the drain pan 90. However, it may be undesirable to have the evaporator 68 disposed on or at the base 100 of the drain pan 90, as accumulated condensate within the drain pan 90 may submerge, at least partially, the evaporator 68 causing damage (e.g., rusting, etc.) to the evaporator 68 or the formation of air quality concerns (e.g., mold, etc.). Additionally, portions of the evaporator 68 below the sidewall 102 of the drain pan 90 may have decreased effectiveness/efficiency due to reduced air flow (e.g., supply air stream 86), hampered by the sidewall(s) 102 of the drain pan 90. As such, in some embodiments, a riser 98 may be implemented to maintain the evaporator 68 a height 104 off the base 100 of the drain pan 90. For example, the drain pan adapter 94 may be disposed on a top surface of the riser 98, opposite the base 100 of the drain pan 90. The riser 98 may provide increased efficiency (e.g., per area) of the evaporator 68 and maintain the evaporator above the condensate accumulated in the drain pan 90. In some embodiments, the riser 98 may be generally rectangular, with flat surfaces for engaging the drain pan adapter 94 and/or the base 100 of the drain pan 90. Additionally, or alternatively, the riser 98 may have surfaces with complementary shapes to engage the drain pan adapter 94 and/or the base 100 of the drain pan 90. As should be appreciated, the riser 98 may be of any suitable shape, depending on implementation, to provide an increase in height 104 of the evaporator 68 above the base 100 of the drain pan 90.

However, while being raised (e.g., via the riser 98) may provide certain benefits for the evaporator 68, such as those stated above, raising the lower portion 92 of the evaporator 68 may increase the risk of blow off (e.g., condensate displaced by the air flow), by reducing the effectiveness of the height of the sidewall 102. However, as discussed further below the drain pan adapter 94 may provide features for retaining the evaporator 68 (e.g., within the drain pan 90 and/or at the raised height 104), while reducing the likelihood of blow off and allowing condensate to drain from the evaporator 68 into the drain pan 90. In some embodiments, the drain pan adapter 94 may be fastened to the top surface of the riser 98 such as via a water-resistant adhesive and/or via one or more fasteners such as rivets, screws, nut-and-bolts, etc. Furthermore, in some embodiments, the drain pan adapter 94 may be made integral with the riser 98, and the riser 98, and/or drain pan adapter 94 may be made integral with or fastened to the drain pan 90. For example, in some embodiments, the drain pan adapter 94 may be molded together with the riser 98 and/or the drain pan 90.

Figure 7:
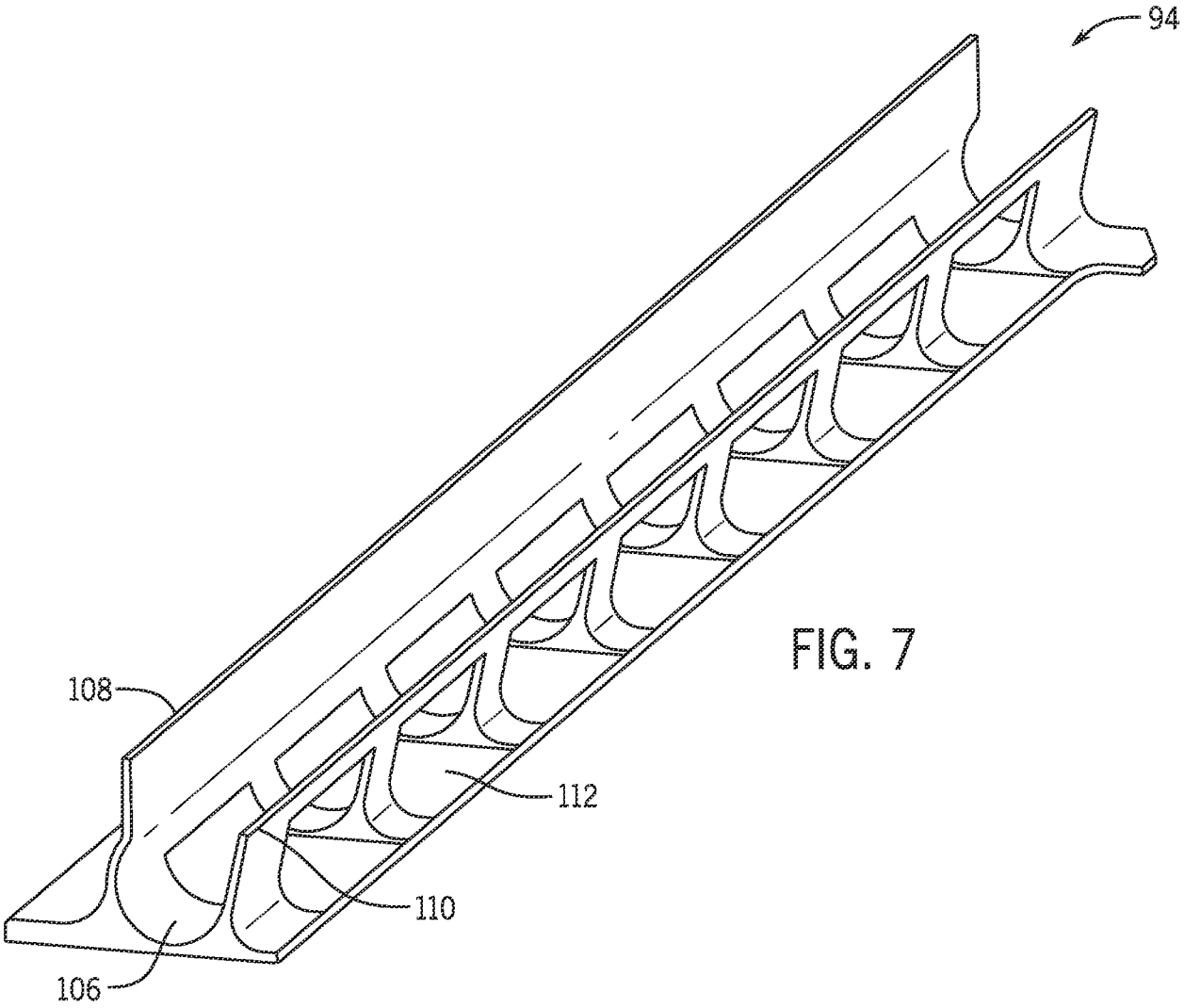
FIG. 7 is a perspective view of the drain pan adapter of FIG. 6 in accordance with an aspect of the present disclosure.
Figure 8:
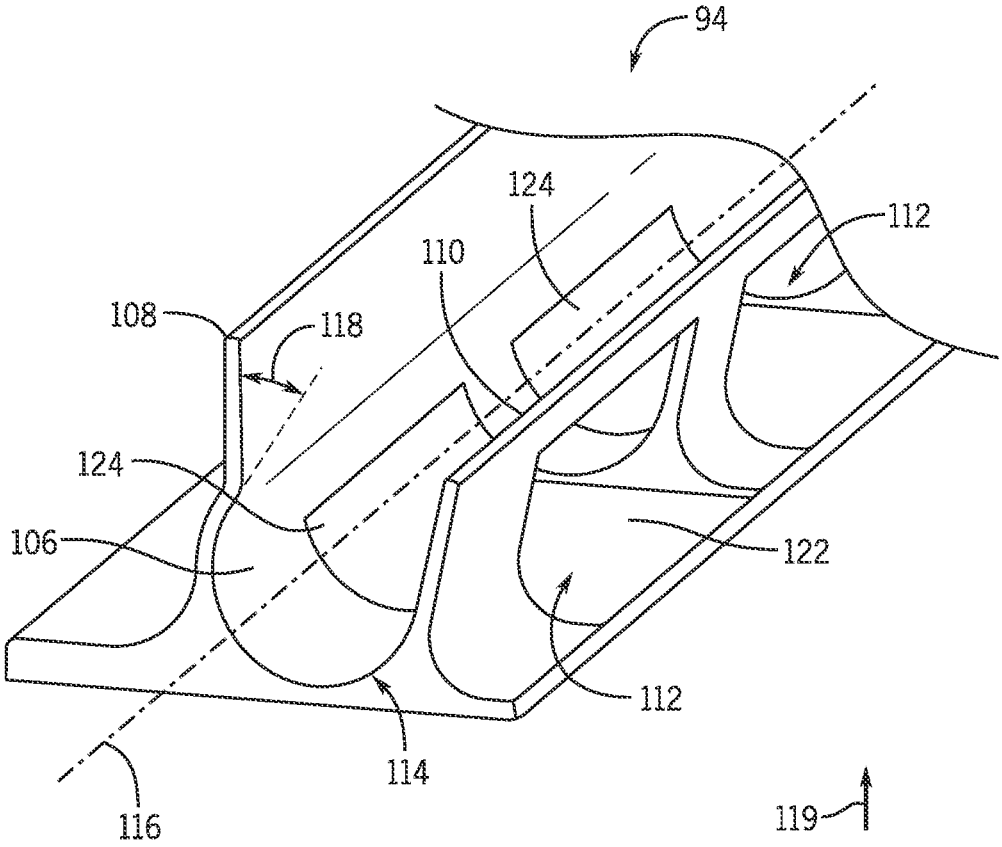
FIG. 8 is a perspective view of the drain pan adapter of FIG. 6 in accordance with an aspect of the present disclosure.
Figure 9:
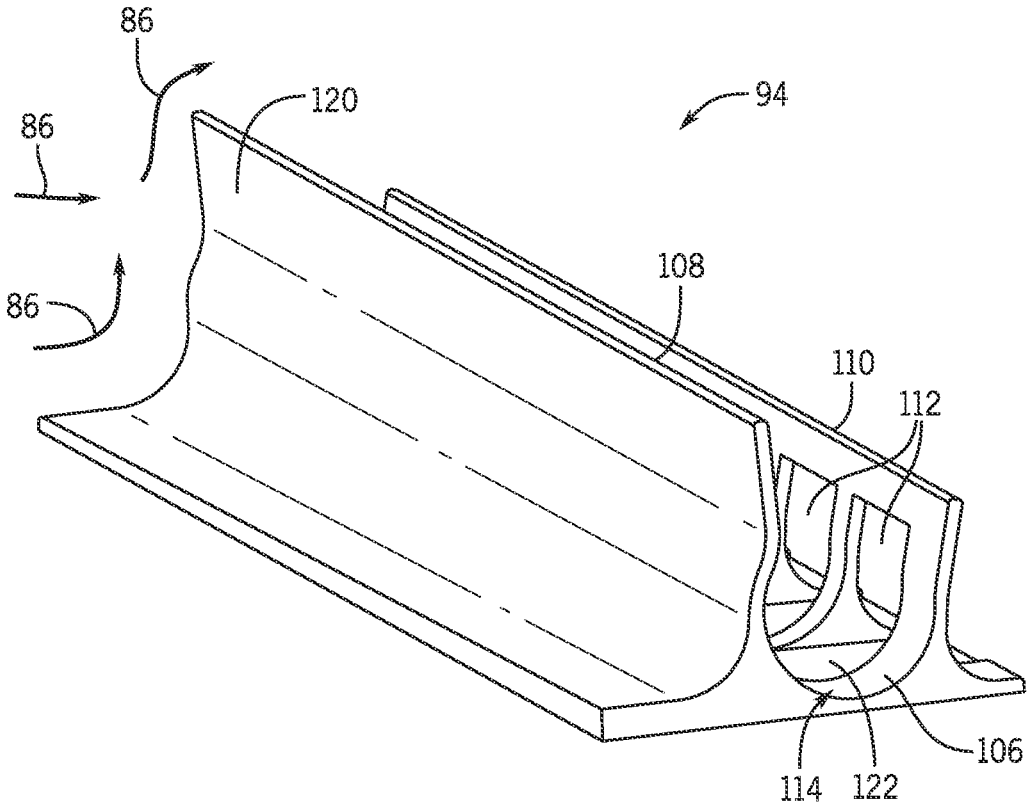
FIG. 9 is a perspective view of the drain pan adapter of FIG. 6, in accordance with an aspect of the present disclosure.

FIGS. 7-9 are perspective views of a drain pan adapter 94 having a coil receiver 106, for interfacing with the evaporator 68, a first retaining arm 108, a second retaining arm 110, and one or more openings 112 to allow condensate to drain into the drain pan 90 from the evaporator 68. In some embodiments, the coil receiver 106 may have a complementary shape to that of the lower portion 92 of the evaporator 68 to engage the evaporator 68. As discussed herein, the drain pan adapter 94 may structurally support, at least partially, the evaporator 68 within the HVAC unit 12, 56, 88. For example, the evaporator 68 may engage the coil receiver 106, and the coil receiver 106, first retaining arm 108, second retaining arm 110, or a combination thereof may limit lateral movement of the evaporator 68 and/or support at least a portion of the weight of the evaporator 68. In the depicted embodiment, the coil receiver 106 has a curved portion 114 about an axis 116. For example, the coil receiver 106 may have a semi-circular or approximately semi-circular cross section (e.g., having curvature that extends between 45 degrees and 200 degrees about the axis 116). Additionally, the first retaining arm 108 and the second retaining arm 110 extend from the curved portion 114 and may be at tangential angles from the curved portion 114 or extend at a flared angle 118 away from the curved portion 114, as shown in FIG. 8. Moreover, in some embodiments, the flared angle 118 may be achieved in segments, such that the first retaining arm 108 and/or the second retaining arm 110 are formed by multiple segments at different angles, relative to the tangent of the curved portion 114 or a vertical axis 119 (e.g., parallel to gravity). In some embodiments, the flared angle 118 may assist in seating (e.g., during installation) the evaporator 68 within the coil receiver 106. As should be appreciated, the coil receiver 106 may have any suitable shape (e.g., flat, arched, parabolic, semi-elliptical, etc.) to engage the evaporator 68. In some embodiments, the first retaining arm 108 and/or the second retaining arm 110 may be formed integrally with the coil receiver 106. Furthermore, in some embodiments, the drain pan adapter 94 may be formed together or formed in on or more individual pieces and fastened (e.g., via epoxy, welding, and/or mechanical fasteners) together.

As discussed herein, condensate may generally drain past the bottom portion 92 of the evaporator 68, and droplets may form on or be carried to (e.g., by gravity) the lowermost portion of the bottom portion 92 of the evaporator 68, which may contact the coil receiver 106. In some embodiments, the first retaining arm 108 and/or the second retaining arm 110 may prevent or reduce blow off by blocking the air flow (e.g., supply air stream 86) from directly blowing on the lowermost portion, where condensate is most likely to accumulate. For example, as depicted in FIG. 9, a wall 120 of the first retaining arm 108 may interrupt the air flow (e.g., supply air stream 86) from directly impacting the lowermost portion of the evaporator 68, where larger condensate droplets may form/accumulate. As should be appreciated, while the first retaining arm 108 may disrupt the air flow upstream of the evaporator, the second retaining arm may disrupt the air flow downstream of the evaporator 68 such that a portion of the air flow from the lowermost portion of the evaporator 68 is reduced and/or moisture carried thereby is intercepted. By reducing the air flow over such regions of the evaporator 68, the likelihood of the condensate being displaced by the air flow is reduced.

Additionally, in some embodiments, the first retaining arm 108 and/or the second retaining arm 110 may include openings 112 that allow the condensate to drain from the evaporator 68, through the drain pan adapter 94, and into the drain pan 90. Furthermore, in some embodiments, the adapter base 122 may extend from the coil receiver 106 through the openings 112 to facilitate the removal of the condensate toward the downstream (e.g., relative to the air flow) side of the drain pan adapter 94. For example, in some embodiments, the adapter base 122 may be slanted away from the coil receiver 106 (e.g., away from a centerline of the coil receiver 106 coaxial with the axis 116) to facilitate drainage of the condensate. Additionally, in some embodiments, a recessed portion 124 of the coil receiver 106 and/or the first retaining arm 108 may allow drainage of the condensate from the side of the coil receiver 106 opposite the openings 112. For example, in the illustrated embodiment, condensate may drain under the evaporator 68 through the recessed portions 124 of the coil receiver 106 and/or first retaining arm 108. Additionally or alternatively, openings 112 may be implemented on the upstream side of the drain pan adapter 94 or both on the upstream and downstream side of the drain pan adapter 94. For example, the openings 112 may be implemented in the first retaining arm 108 and/or the second retaining arm 110. Moreover, in implementations with openings 112 in both the first retaining arm 108 and the second retaining arm 110, the adapter base 122 may be sloped away from the coil receiver 106 (e.g., such that a peak is formed under the evaporator 68) to facilitate drainage of the condensate through the openings 112.

As set forth above, embodiments of the present disclosure may provide one or more technical effects useful for efficiently capturing and/or collecting condensate that forms and/or accumulates on a heat exchanger and is dislodged from the heat exchanger by gravity and/or an air flow directed across the heat exchanger. In particular, a drain pan adapter 94 may allow for the effective direction of condensate into a drain pan 90 in conjunction with an evaporator 68, such as a microchannel evaporator 68. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A heating, ventilation, and air conditioning (HVAC) system, comprising:

a heat exchanger configured to condition an air flow, wherein conditioning the air flow generates condensate;

a drain pan configured to collect the condensate; and a drain pan adapter coupled between the drain pan and the heat exchanger, the drain pan adapter comprising:

a coil receiver configured to engage a portion of the heat exchanger; and a retaining arm configured to reduce an amount of the air flow over the portion of the heat exchanger; wherein the coil receiver is configured to support at least a portion of a weight of the heat exchanger.

2. The HVAC system of claim 1, wherein the drain pan adapter comprises a second retaining arm comprising one or more openings configured to direct the condensate from the portion of the heat exchanger to the drain pan.

3. The HVAC system of claim 2, wherein the second retaining arm is disposed downstream, relative to the air flow, of the heat exchanger.

4. The HVAC system of claim 3, wherein the retaining arm is disposed upstream, relative to the air flow, of the heat exchanger.

5. The HVAC system of claim 2, wherein a base of the drain pan adapter extends from the coil receiver through the one or more openings.

6. The HVAC system of claim 5, comprising a riser configured to raise the base of the drain pan adapter a height above a second base of the drain pan.

7. The HVAC system of claim 5, wherein the base is slopped away from the heat exchanger.

8. The HVAC system of claim 1, wherein the coil receiver, the retaining arm, or a combination thereof is configured to reduce a lateral movement of the heat exchanger relative to a vertical axis parallel to gravity.

9. The HVAC system of claim 1, wherein the heat exchanger comprises a microchannel evaporator, wherein the coil receiver comprises a complementary shape to a lower portion of the microchannel evaporator.

10. A drain pan adapter comprising:

a coil receiver configured to engage a portion of a heat exchanger;

a retaining arm disposed on a first side of the coil receiver and comprising one or more openings; and a further retaining arm on a second side, configured to reduce an amount of the air flow over the portion of the heat exchanger, wherein the second side is located opposite to the first side, wherein the coil receiver is configured to engage a portion of a heat exchanger between the first retaining arm and the second retaining arm; and a base extending from the coil receiver and through the one or more openings and configured to direct condensate away from the portion of the heat exchanger and through the one or more openings.

11. The drain pan adapter of claim 10, comprising a second retaining arm disposed on a second side of the coil receiver, opposite the first side, and configured to reduce an amount of air flow over the portion of the heat exchanger.

12. The drain pan adapter of claim 11, wherein the base comprises a recessed portion configured to direct condensate from the second side of the coil receiver, under the coil receiver, and through the one or more openings.

13. The drain pan adapter of claim 10, wherein the coil receiver comprises a curved receiver configured to contact the portion of the heat exchanger.

14. The drain pan adapter of claim 13, wherein the retaining arm is disposed at a flared angle beyond a tangent of the curved receiver.

15. A heating, ventilation, and air conditioning (HVAC) unit, comprising:

an evaporator configured to condition an air flow, wherein conditioning the air flow generates condensate;

a drain pan configured to collect the condensate; and a drain pan adapter coupled between the drain pan and the evaporator, the drain pan adapter comprising:

a coil receiver configured to engage a portion of the evaporator;

a retaining arm comprising one or more openings; and a further retaining arm on a second side, configured to reduce an amount of the air flow over the portion of the heat exchanger, wherein the second side is located opposite to the first side, wherein the coil receiver is configured to engage a portion of a heat exchanger between the first retaining arm and the second retaining arm; and a base extending from the coil receiver and through the one or more openings and configured to direct the condensate away from the portion of the evaporator and through the one or more openings.

16. The HVAC unit of claim 15, wherein the base is sloped away from the coil receiver and toward the one or more openings.

17. The HVAC unit of claim 15, wherein retaining arm is disposed on a downstream side, relative to the air flow, of the coil receiver, and wherein the drain pan adapter comprises a second retaining arm disposed on an upstream side, relative to the air flow, of the coil receiver, wherein the second retaining arm is configured to reduce an amount of the air flow over the portion of the evaporator.

18. The HVAC unit of claim 17, wherein the base is recessed beneath the coil receiver and configured to direct condensate from the upstream side and the downstream side of the coil receiver.

19. The HVAC unit of claim 15, comprising:

a compressor;

a condenser; and a housing comprising the evaporator, the drain pan, the drain pan adapter, the compressor, and the condenser.

* * * * *